US007229041B2

(12) United States Patent
Cohen et al.

(10) Patent No.: US 7,229,041 B2
(45) Date of Patent: Jun. 12, 2007

(54) LIFTING LID CRUSHER

(75) Inventors: Douglas J. Cohen, Bexley, OH (US); Eric E. Dombrowski, North Royalton, OH (US); Stan Wegrecki, Maple Heights, OH (US); Michael E. Winemiller, Parma, OH (US)

(73) Assignee: Ohio Central Steel Company, Reynoldsburg, OH (US)

( * ) Notice: Subject to any disclaimer, the term of this patent is extended or adjusted under 35 U.S.C. 154(b) by 366 days.

(21) Appl. No.: 10/881,110

(22) Filed: Jun. 30, 2004

(65) Prior Publication Data

US 2006/0086850 A1 Apr. 27, 2006

(51) Int. Cl.
*B02C 13/282* (2006.01)
*B02C 13/31* (2006.01)
*B02C 13/00* (2006.01)

(52) U.S. Cl. ..... 241/285.3; 241/32; 241/189.1; 241/285.2

(58) Field of Classification Search ..... 241/32, 241/185.5–190, 285.2–290
See application file for complete search history.

(56) References Cited

U.S. PATENT DOCUMENTS 3,857,519 A * 12/1974 Schafer et al. ..... 241/185.5
4,867,382 A * 9/1989 Manschwetus ..... 241/101.2
5,332,164 A * 7/1994 Page ..... 241/239
5,718,389 A * 2/1998 Finken et al. ..... 241/27

* cited by examiner

*Primary Examiner*—Derris H. Banks
*Assistant Examiner*—Jason Y. Pahng
(74) *Attorney, Agent, or Firm*—Jason H. Foster; Kremblas, Foster, Phillips & Pollick

(57) ABSTRACT

A blockage clearance apparatus for a crusher that has a housing and a lid and at least one anvil mounted to the lid for crushing material. The housing contains a rotatable rotor with radial blow bars against which crushable materials are forced during operation. In operation, the materials are fed into the crusher, impacted by at least two blow bars and thrown against at least one anvil for crushing. The blockage clearance apparatus includes means for moving the lid and the anvil relative to the rotor during operation, means for inhibiting the material in the housing from exiting the housing when the lid is spaced from the housing during operation, and means for stopping movement of the lid relative to the rotor.

13 Claims, 7 Drawing Sheets

LIFTING LID CRUSHER

BACKGROUND OF THE INVENTION

1. Field of the Invention

This invention relates generally to an apparatus for crushing materials, and more specifically to a blockage clearing apparatus and method for clearing a blockage during operation of a crushing apparatus.

2. Description of the Related Art

When concrete, asphalt, virgin rock or any other breakable materials need to be reduced in size, a machine referred to as a crusher is used. A crusher is normally mounted on a fixed or portable apparatus called a crushing machine. The materials are poured into the crushing machine in large pieces and are crushed into a smaller, more manageable size. The machine produces a smaller particulate product, which can be recycled and reused for other projects.

A conventional crushing machine, as illustrated in FIGS. 1 to 3, has a hopper 10 with vibrating steel plates 12 to move the crushable materials toward the crusher 14. The hopper 10 receives the materials and has grizzlies 16, which are vibrating steel bars that act as a sieve to separate the smaller materials from the larger materials. The smaller materials are sifted through the grizzlies 16 to reduce wear on the crusher, because already reduced-size product need not pass through the crusher. The smaller particles fall onto a conveyer 18 that moves the small particles out of the machine into a pile beside the machine. If all of the materials need to be crushed, a gate can be used to send all materials through the crusher.

The larger materials move across the grizzlies 16 through an opening 20 into the crusher 14. The crusher 14 has a housing 22 with a lid 24, and the housing 22 contains a rotor 26 with radial blow bars 28*a* and 28*b*. Conventional crushers typically have two, three or four blow bars. During operation, the rotor 26 rotates the blow bars 28*a* and 28*b* at a rate between about 300 rpm and 800 rpm. The blow bars impact the large, crushable pieces and throw them against at least one anvil 30 for breaking the larger pieces into smaller particles. The anvil and blow bars are made of an extremely tough material, and are readily replaced when worn. Directly beneath the rotor 26 is a vibrating plate, or the conveyer 38, which moves the materials out of the crusher 14 and through the rest of the machine. The crushed materials are moved from the machine into a pile at the end of the machine or into a waiting truck.

One problem with this conventional machine is that large pieces that are placed into the hopper 10 can plug or block the crusher 14 upon entry through the opening 20, or even before entering the opening. Plugging occurs when the material in the hopper backs up due to being arranged in or near the opening 20 in such a way that normal passage to the rotor, where the pieces can be reduced in size, is hindered. When the large materials plug the conventional crushing machine, the rotor has to be turned off in order to free the materials from the crusher, such as by opening the crusher to unplug it, by using vibratory hammers to break up blocking materials, or by using heavy equipment, such as a loader bucket, to move the blocking materials.

Conventional crushing machines include numerous safety features that do not allow the lid 24 of the crusher 14 to be opened while the crusher 14 is in operation. Therefore, the only way to open the lid in a conventional crusher is to stop the rotation of the rotor. Additionally, due to the size and weight of the materials and the crushing machine, a crowbar or backhoe is needed to dislodge the materials from the crusher 14. This process not only slows the progress of the crushing process, it requires additional tools and manpower to free the lodged materials.

Therefore, there is a need for an improved method and apparatus for crushing and for dislodging materials that may plug the crushing machine while in operation.

BRIEF SUMMARY OF THE INVENTION

The invention is a crusher blockage clearance apparatus mounted or otherwise working in conjunction with a crusher that has a housing and a lid and at least one anvil mounted to the lid. The housing contains a rotatable rotor with at least two radial blow bars against which crushable materials are forced during operation. In operation, the materials are fed into the crusher, impacted by said at least two blow bars and thrown against said at least one anvil for breaking into smaller pieces. The crushing apparatus includes means, such as a prime mover, for moving the lid and said at least one anvil relative to the rotor during operation and means, such as lateral guards, for inhibiting the material in the housing from exiting the housing when the lid is spaced from the housing during operation. In a preferred embodiment, means, such as a mechanical stop or sensors combined with a computer, for stopping movement of the lid relative to rotor are also part of the invention.

The lid of the crusher is preferably mounted to a pivot for pivoting the lid relative to the housing. At least one prime mover, preferably a hydraulic ram, links the lid and the housing for pivoting the lid and attached anvil about the pivot relative to the rotor. Guards extend a portion of the length of the lid and prevent crushable materials from exiting the crusher rapidly during a blockage clearance operation. When the ram is actuated, which can occur while the rotor is rotating, the effective opening of the material flow path is increased enough to unplug the blockage. Due to the guards, no material exits the crusher at high speeds, and due to safety devices, such as the mechanical stops and sensors that signal the controlling computer, the crusher will not open too far.

Figure 1:
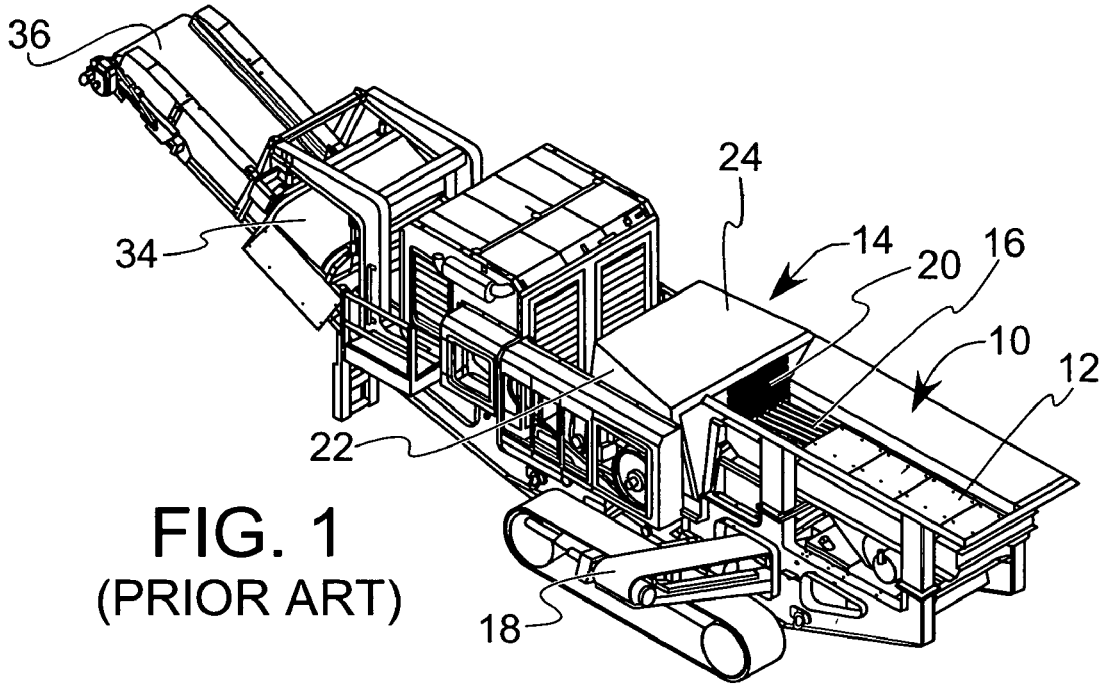
FIG. 1 (PRIOR ART)
FIG. 1 is a view in perspective illustrating a conventional crushing machine.
Figure 2:
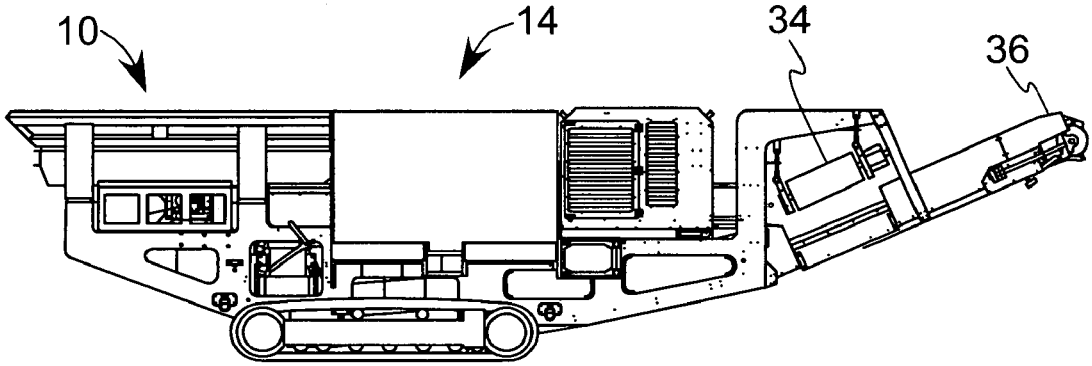
FIG. 2 (PRIOR ART)
FIG. 2 is a side view in perspective illustrating the embodiment of FIG. 1.
Figure 3:
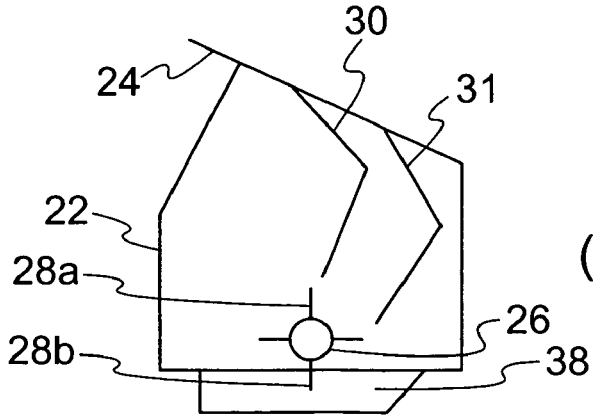
FIG. 3 (PRIOR ART)
FIG. 3 is a schematic illustrating the crushing apparatus illustrating the embodiment of FIG. 1.

In describing the preferred embodiment of the invention, which is illustrated in the drawings, specific terminology will be resorted to for the sake of clarity. However, it is not intended that the invention be limited to the specific term so selected and it is to be understood that each specific term includes all technical equivalents, which operate in a similar manner to accomplish a similar purpose. For example, the word connected or term similar thereto is often used. They are not limited to direct connection, but include connection through other elements where such connection is recognized as being equivalent by those skilled in the art.

DETAILED DESCRIPTION OF THE INVENTION

Figure 4:
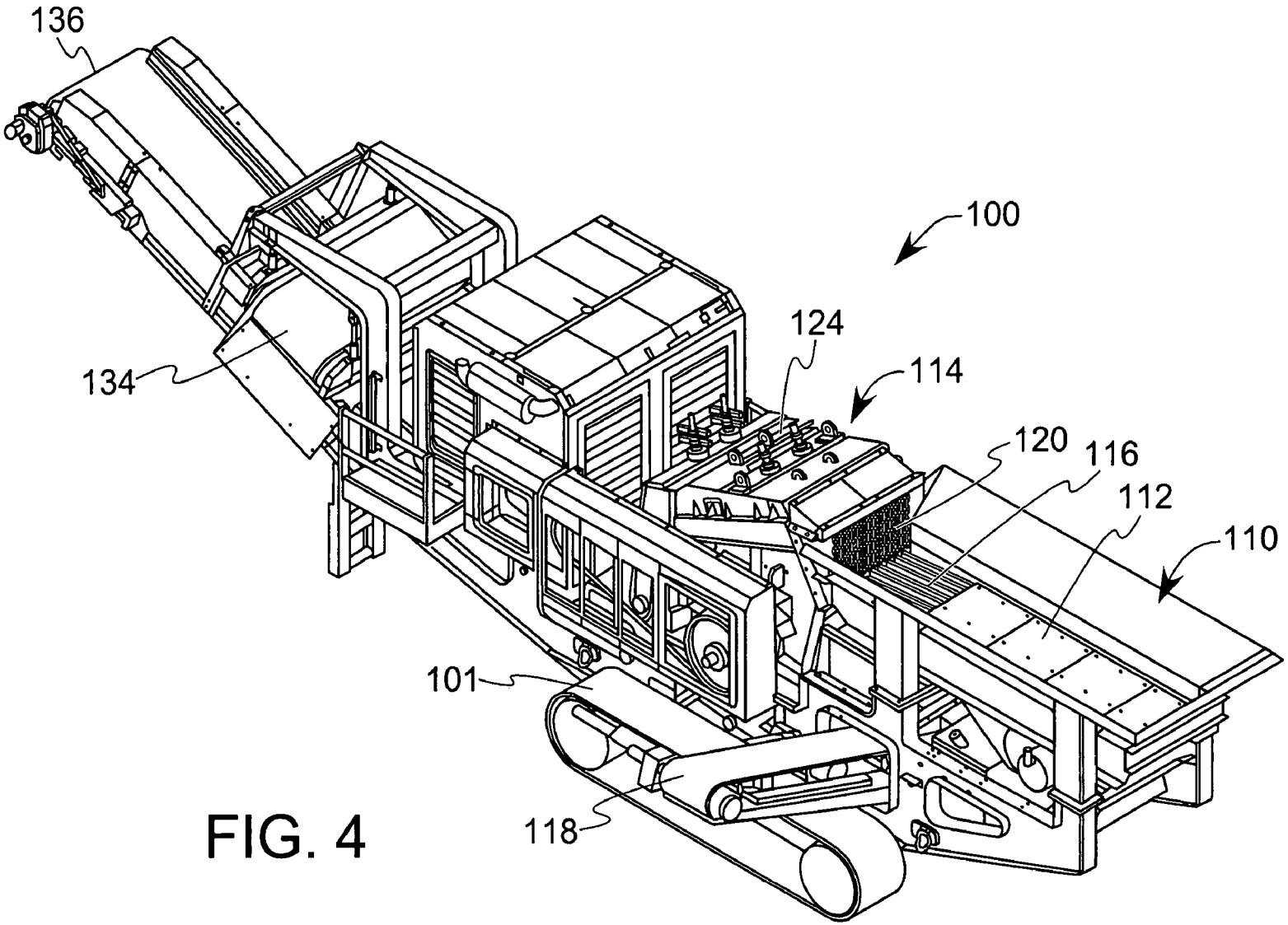
FIG. 4 is a view in perspective illustrating the preferred embodiment of the present invention.
Figure 11:
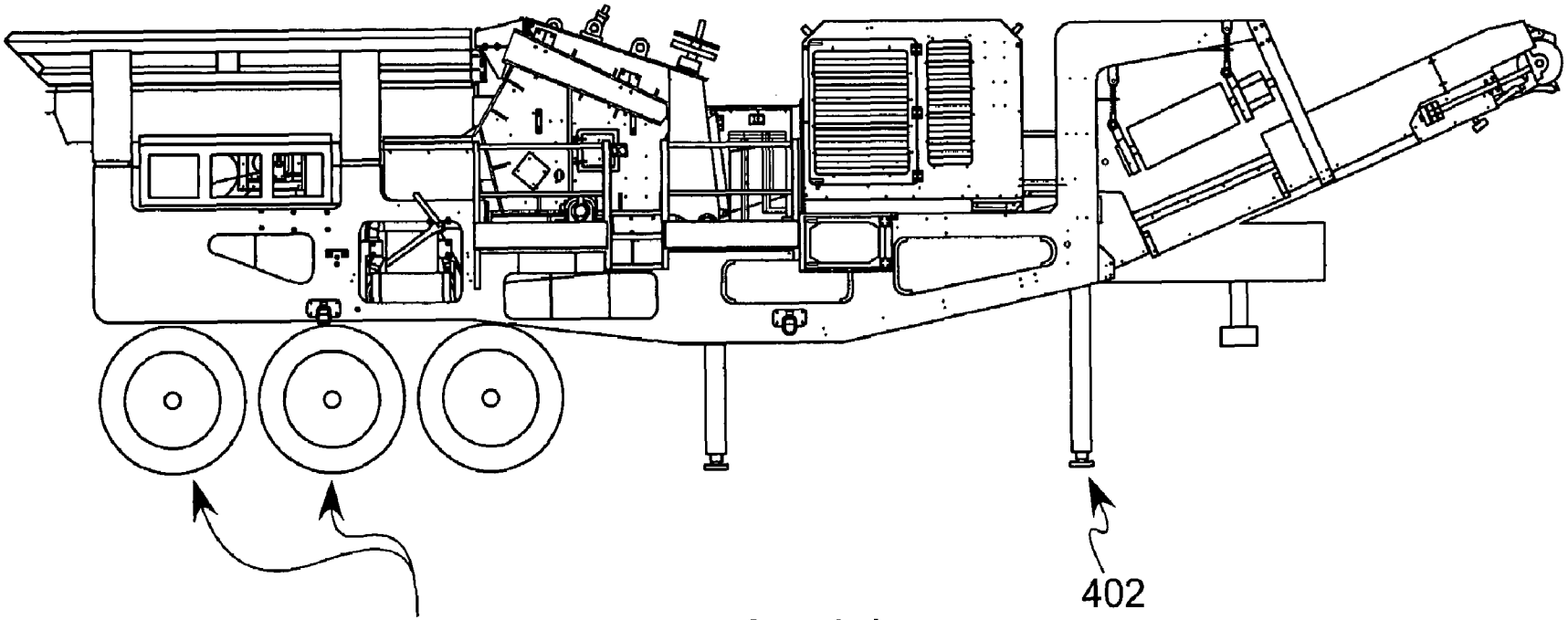
FIG. 11 is a side view illustrating an alternative embodiment of the present invention.

The crushing apparatus 100 that contains the present invention, and is illustrated in FIG. 4, has many conventional components that work in cooperation with the new blockage clearance apparatus. For example, the crushing apparatus 100 has a hopper 110 with vibrating steel plates 112 that move crushable material toward the crusher 114. The smaller particles fall through the vibrating grizzlies 116 and onto a conveyer belt 118, which transports them to a pile adjacent the apparatus 100. The larger pieces move through a chained entry 120 into the crusher 114, which is described in further detail below. Once the materials are crushed in the crusher 114, they are moved through the machine on a series of conveyer belts 134 and 136. The first conveyer belt 134 has a magnetic plate, which attracts any rebar or other ferromagnetic materials that may be in the crushed material and moves it off to the side of the machine into a pile. The remaining crushed materials are moved along the final conveyer belt 136 and into a pile or a waiting truck to be disposed of or recycled. The crushing apparatus is mounted to movable tracks 101, which are conventional for bulldozers, track-hoes and other excavating machines. Alternatively, however, the crushing apparatus can be mounted to a conventional frame having wheels 400 and a hitch 402, as shown in FIG. 11, for towing behind a tractor-trailer vehicle for movement along the ground.

Figure 5A:
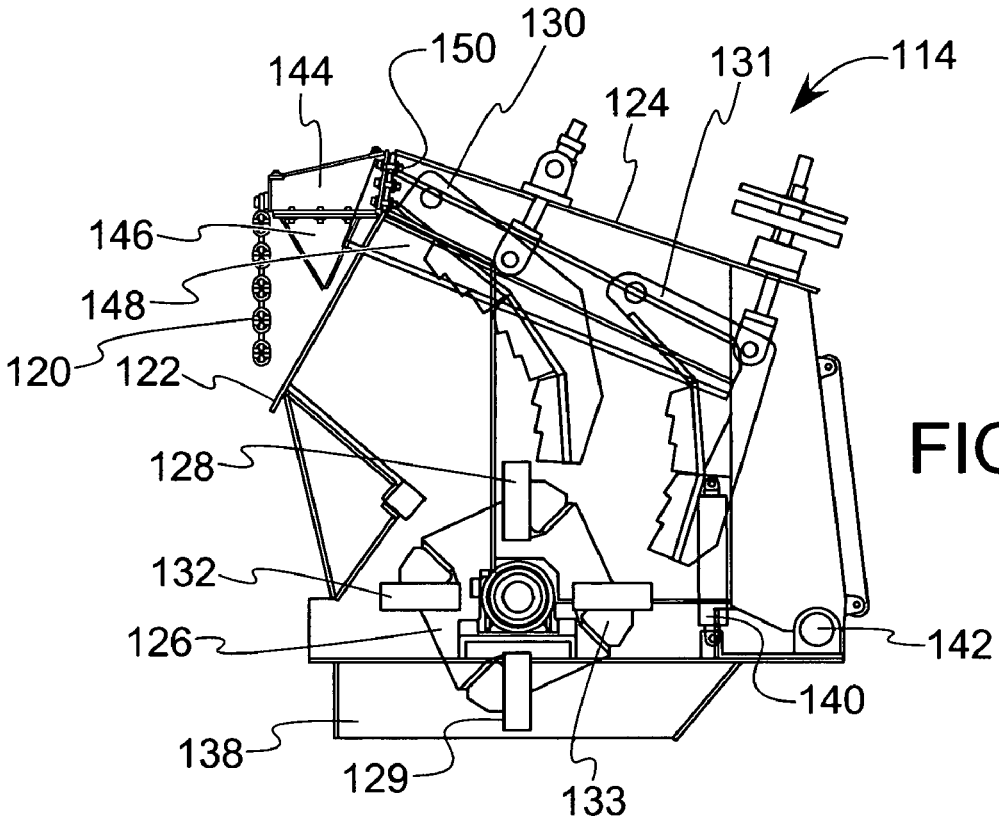
FIG. 5*a* is a cross-sectional schematic side view illustrating the crusher embodiment of FIG. 4 with the lid closed.
Figure 5B:
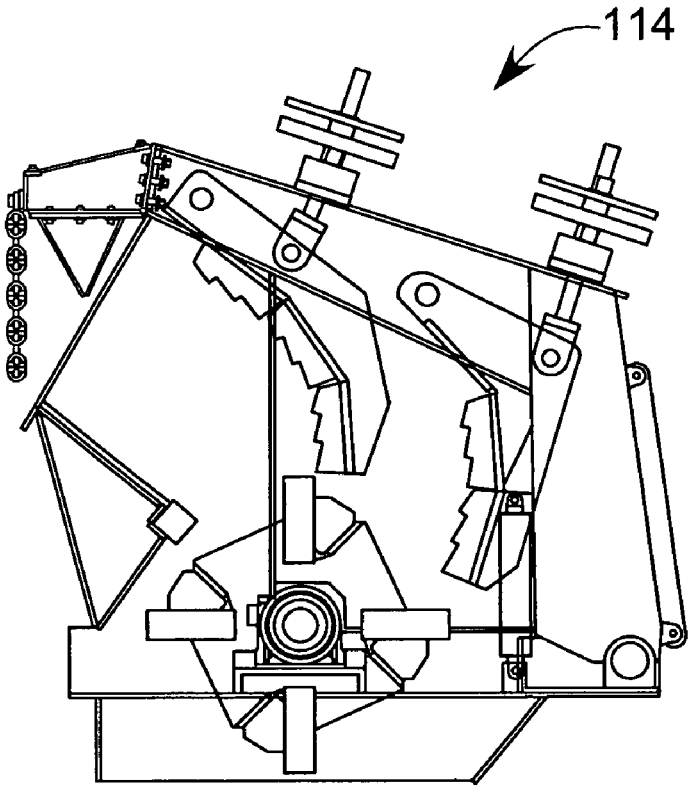
FIG. 5*b* is a cross-sectional schematic side view illustrating the crusher embodiment of FIG. 4 with the lid closed and the guard removed.

The improved part of the crushing apparatus is the crusher 114, which has a housing 122 and a lid 124 and the anvils 130 and 131 mounted to the lid 124, as illustrated in FIG. 5. The anvils 130 and 131 are conventional, and mount to the lid 124 in a conventional manner. The housing 122 has a rotatable rotor 126 with two radial blow bars 128 and 129 against which crushable materials are forced during operation. Of course, there could be three or four blow bars rather than only two. The rotor 126 is mounted in bearings to the housing 122 in a conventional manner, and is rotatably driven in a conventional manner, such as by a belt and pulley drive system connected to an engine.

In the preferred embodiment, the lid 124 is mounted to a pivot, such as the hinge 142, for pivoting the lid 124 relative to the housing 122. Of course, any sufficient pivoting mechanism can substitute for the hinge 142. The hinge 142 is mounted to both the housing 122 and the lid 124. A prime mover, preferably the hydraulic ram 140, is mounted to the lid 124 at one end and the housing 122 at the opposite end for pivoting the lid 124 and attached anvils 130 and 131 about the hinge 142 relative to the rotor 126 and housing 122. Any conventional prime mover will suffice. There are preferably two such hydraulic rams with one on each side, one of which is not visible in the drawings. The guards 148 and 149, extending a portion of the length of the lid 124, keep the crushable materials from rapidly exiting the crusher 114 during a blockage clearance operation, as described more fully below.

In the preferred embodiment, the tunnel top 144 is mounted, by bolts 150, to the lid 124 distal from the hinge 142. The tunnel top 144 is preferably removably mounted to the lid. A stop 146 is mounted, by welding or bolts, to the tunnel top 144, in the path of the housing 122, for limiting the range of motion of the lid 124 during blockage clearance operations. There can be any number of the preferred stops 146 mounted to the tunnel top 144. Additionally, any mechanical stop will function to limit the motion of the lid 124. For example, a chain can be attached to both the lid and the housing, which would limit the movement of the lid to the amount of slack in the chain. It is not possible to describe all mechanical stops that can be used to limit the movement of the lid 124. However, a person of ordinary skill will recognize that many structures can be used to so limit the movement of the lid.

In operation, crushable material pieces enter the crusher 114 through the chained entry 120 in a variety of sizes. When a piece of material that is too large enters the crusher 114, or lodges in the entry 120 prior to entering the crusher 114, the piece may become wedged between the inlet housing and the anvil 130, or may seat against the anvil 130 without being close to the rotor 126, and this arrangement of material prevents the material from being moved through the crusher 114. The improved crushing apparatus 100 enables the blockage to be cleared while the crusher 114 is still running. The machine clears the blockage through a mechanical process as described below.

When material pieces block the crusher 114, a blockage clearance operation is activated by a remote control (not shown), by pressing a button to actuate the prime mover 140. The prime mover 140 elongates, which pivots the lid 124 about the hinge 142, thereby lifting the lid 124, possibly as far as to the position illustrated in FIG. 6. The tunnel top 144 is also lifted with the lid 124, and this moves the attached stop 146 toward its impact point with the housing 122, and closes the gap between the housing 122 and the stop 146. As illustrated in FIG. 5, before the clearance operation the stop 146 is a select distance from its impact point with the housing 122, preferably about six to eight inches. If the lid were raised beyond the position shown in FIG. 6, the stop would impact the housing. However, due to the safety feature of the sensors, as described below, this impact will not take place during normal operation. Instead, it is a backup to the normal safety feature.

As the lid 124 is pivoted away from the rotor 126, the attached anvils 130 and 131 move with the lid 124 away from the rotor 126 and the blow bars 128 and 129, thereby increasing the effective material flow path opening and allowing materials lodged therein to move further and be broken by the crusher 114. By lifting the lid 124 merely 6 to 8 inches, the sizes of the opening of the chained entry 120, and the gaps between the anvils and rotor, are increased, thereby dislodging the materials and providing enough space for the materials to move further into the crusher 114 and be crushed. Once the blockage is cleared, which is noticeable to an observer of the machine, the prime mover is actuated in reverse and the lid 124 lowers to the normal operating position as illustrated in FIG. 5.

The guards 148 and 149 inhibit materials from exiting the crusher 114 during the blockage clearance operation. Where conventional machines have no use for such guards 148 and 149, because clearing a blockage is only done while the machine is off, it is necessary to have the guards 148 and 149 (or some other means for inhibiting material in the housing 122 from exiting). This is because the crusher 114 is opened slightly during operation, and without the guards, material could exit the crusher 114 at a high rate of speed. The guards 148 and 149 serve as obstacles to flying particulate, absorbing kinetic energy from particles at impact and allowing the particles to ricochet back into the housing or fall harmlessly to the ground.

In the preferred embodiment, when the blockage clearance operation is activated, the lid 124 is lifted about 6 to 8 inches, creating gaps between the lid 124 and the housing 122. The guards 148 and 149 fill these gaps created along the length of the lid 124 and obstruct materials exiting the crusher 114 at high speed. The guards 148 and 149 are necessary because the rotor 126 is still rotating at about 300-800 rpm and, therefore, some materials are still being crushed during the blockage clearance operation and may be thrown in a direction toward the gaps, thereby exiting the machine rapidly. The guards 148 and 149 cover the gaps and protect workers from material that could exit the machine and strike someone nearby.

Figure 8:
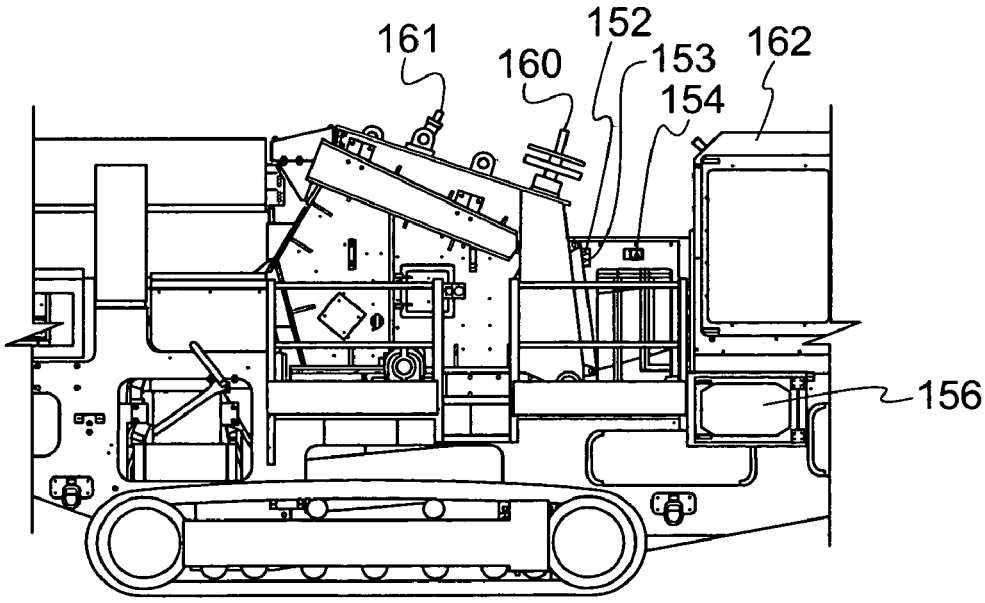
FIG. 8 is an enlarged side view in perspective illustrating the placement of sensors in the preferred embodiment of the present invention.

The sensors 152, 153 and 154, illustrated in FIG. 8, are positioned near the lid 124, also to limit the range of motion of the lid 124. A computer 156 is preferably connected to the sensors 152, 153 and 154 for controlling the operation of the crushing apparatus 100. A "computer", as the term is used herein, can be as complex as a programmable, multipurpose computer or as basic as a single purpose logic circuit. For example, the preferred computer 156 includes relays connected to the sensors and the prime mover. When a particular condition is sensed by one of the sensors, that sensor triggers a relay to engage (or disengage) the prime mover. Of course, a computer would not be necessary if the sensors were capable of actuating a high-power device, such as the prime mover.

The sensors 152, 153 and 154, illustrated in FIG. 8, also aid in preventing damage to the machine or injury to bystanders. If the lid 124 is opened too far, such as if the stop 146 is broken, bent or removed, material in the housing can fly out, because the guards 148 and 149 only provide protection for a small range of lid 124 movement. If the lid moves significantly beyond its anticipated range, the top fixtures 160 and 161 can even puncture the engine bay 162 located behind the lid 124. The sensors and computer prevent such excessive movement.

Figure 6A:
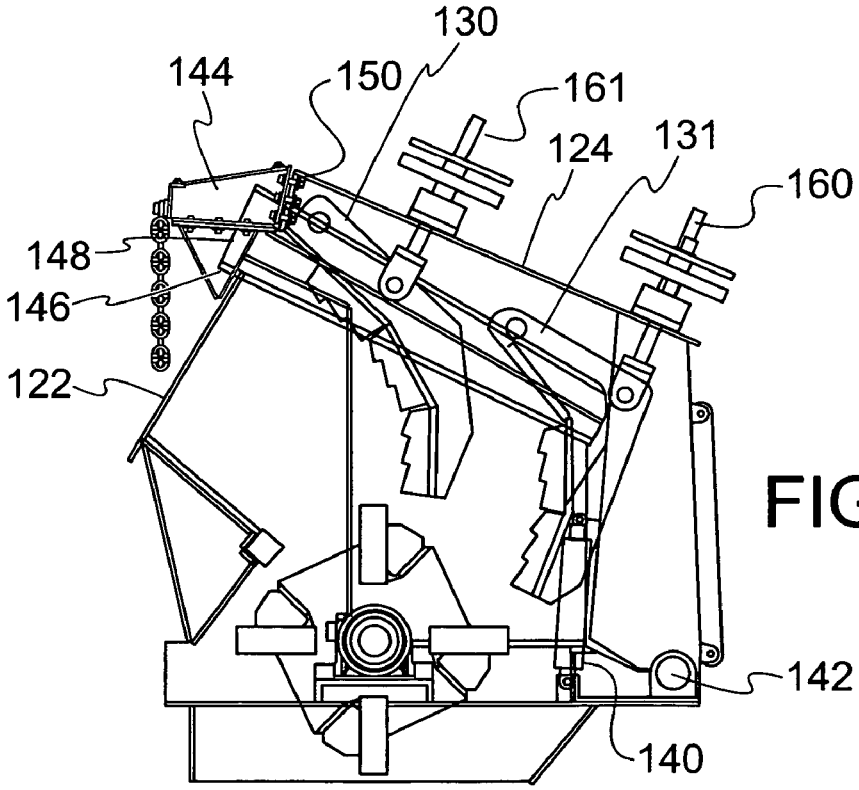
FIG. 6*a* is a cross-sectional schematic side view illustrating the crusher embodiment of FIG. 4 in a blockage clearance position with the lid open.
Figure 6B:
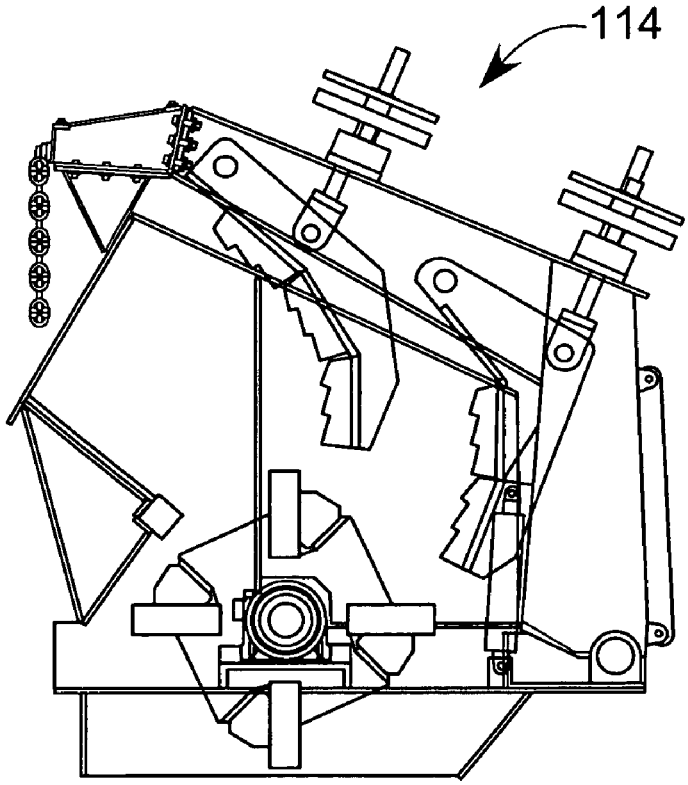
FIG. 6*b* is a cross-sectional schematic side view illustrating the crusher embodiment of FIG. 4 in a blockage clearance position with the lid open and the guard removed.

When the lid 124 opens to the position shown in FIG. 6, a first sensor 152 senses the lid's position and signals the computer, which is programmed to deactivate the power to the remote control (not shown). This stops the movement of the lid 124, by cutting off the "lift" signal from the remote control to the computer. If the lid somehow continues moving, such as by a computer or remote malfunction, a second sensor 153 senses the lid's position and signals the computer, which turns off the entire crushing apparatus 100. If movement continues further, a third sensor 154 turns off the hydraulic cylinder 140. The sensors 152, 153 and 154 and computer thus allow the blockage clearance operation to take place while the machine is in operation but provide safety features that are necessary to minimize harm or injury. Of course, a single sensor could provide similar signals to the computer, and therefore it is contemplated that a single sensor would suffice. However, three sensors are present in the preferred embodiment.

Figure 7:
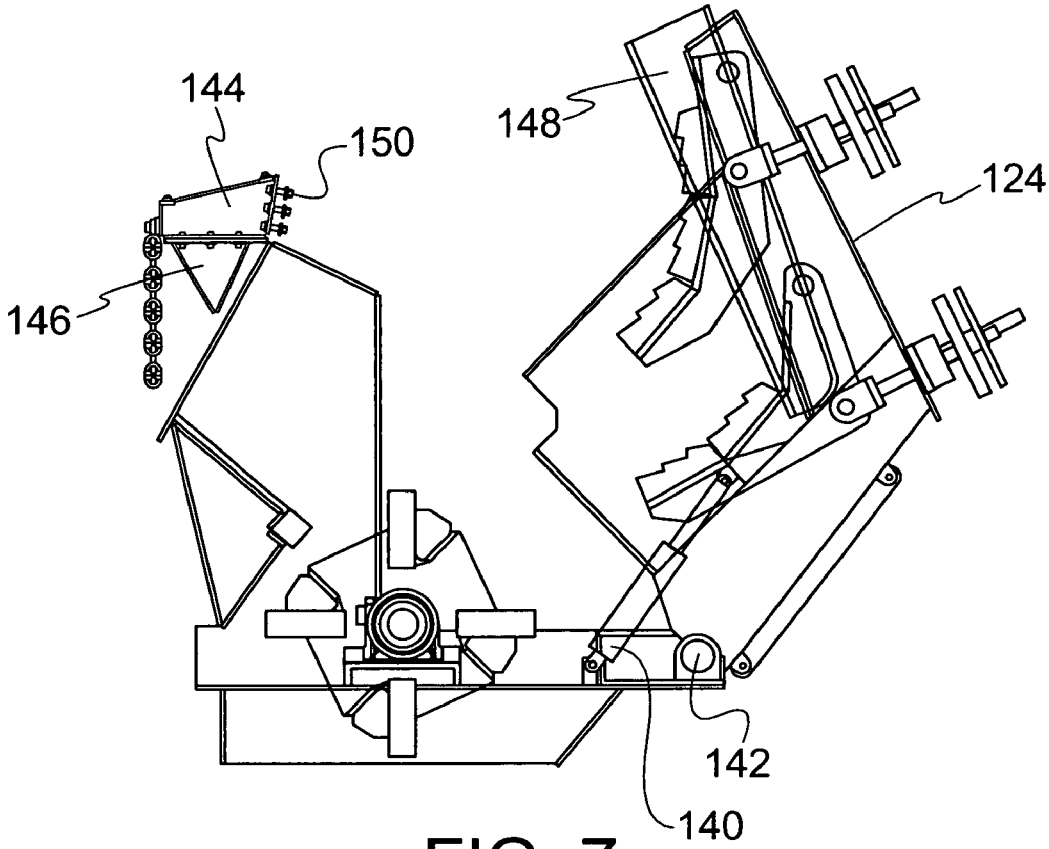
FIG. 7 is an enlarged cross-sectional side view illustrating the crusher embodiment of FIG. 4 illustrating a service position, when the crushing apparatus is not in operation.

FIG. 7 illustrates the crusher 114 in a service position that, due to conventional safety features, can only occur when the crushing apparatus 100 is not in operation, i.e., when it is turned off. The tunnel top 144 and attached stop 146 are disconnected from the lid 124 so that when the hydraulic ram 140 is actuated, the lid 124 can be lifted to a position past the mechanical limitation of the stop 146 and the control limitation of the sensors/computer. Service of the machine can include adding or replacing blow bars or servicing the rotor, but in the preferred embodiment does not include clearing blocked materials unless the normal blockage clearance operation is not successful.

Figure 9:
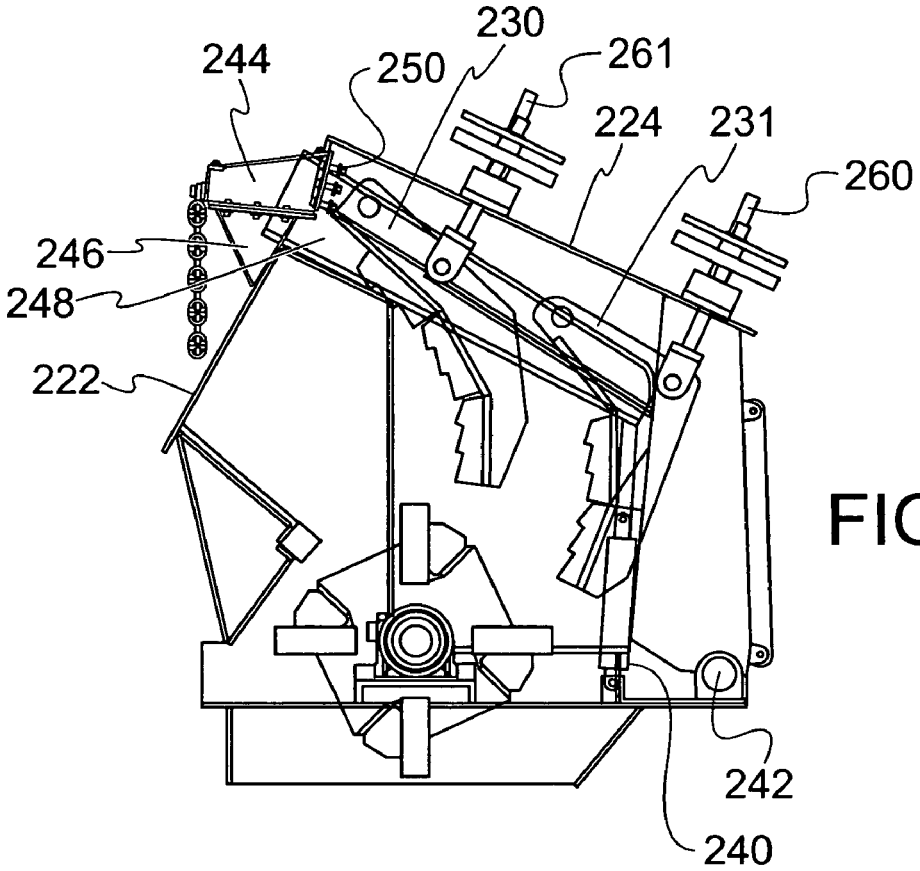
FIG. 9 is an enlarged cross-sectional side view illustrating an alternative embodiment of the present invention.

In a first alternative, illustrated in FIG. 9, the crusher 214 has the mechanical stop 246 without the sensors that are present in the preferred embodiment. In this alternative, the tunnel top 244 and stop 246 are the only features that operate to keep the lid 224 from opening too far during a blockage clearance operation. The stop 246 is moved toward the housing 222 and may even seat against the housing 222 when the lid 224 is at its most extended point to prevent the lid 224 from opening past the distance allowed. The stop 246 thus prevents the lid from opening past the selected distance, until the machine is no longer in operation and the tunnel top 244 is unbolted from the lid 224, which will enable the lid to be opened to the service position.

Figure 10:
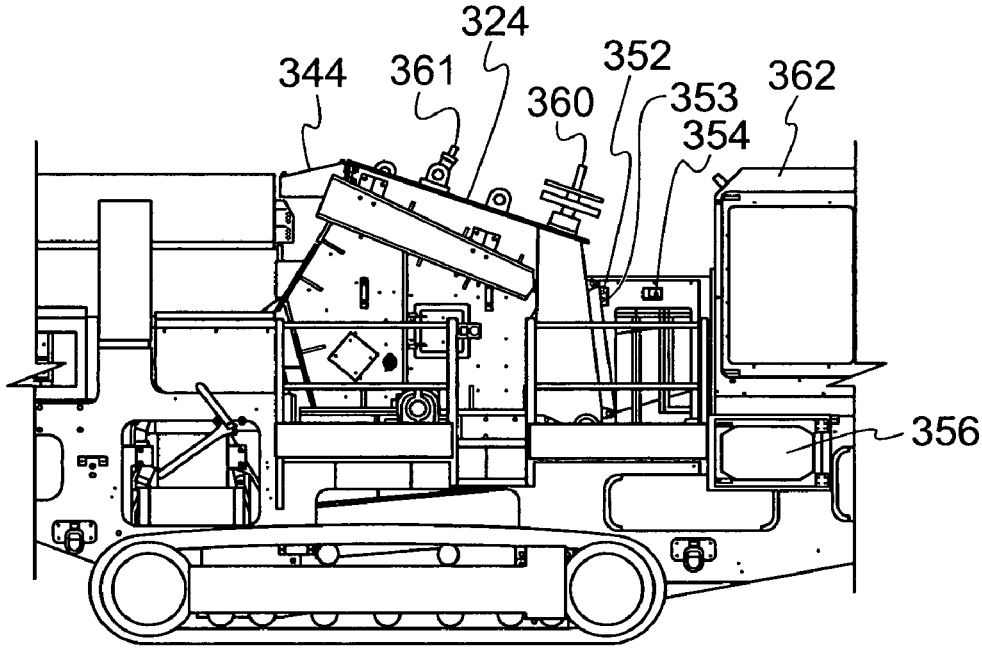
FIG. 10 is an enlarged side view in perspective illustrating the sensors in an alternative embodiment of the present invention.

In a second alternative, illustrated in FIG. 10 the crusher 214 has only the sensors 352, 353 and 354 and the connected computer to stop the movement of the lid 324 during blockage clearance operation. The sensors 352, 353 and 354 are connected to the computer 356 that is programmed to stop movement of the lid 324 after a select distance moved during blockage clearance. The computer 356 can also have a service option, in which the sensors 352, 353 and 354 are overridden only when the tunnel top 344 is unbolted from the lid 324 and the rotor is not rotating so that the lid 324 can be opened to the service position.

It will therefore become apparent that the blockage clearance apparatus uses an improved method in which the lid 124 is lifted slightly while the crusher is in operation or at least the rotor is rotating, by actuating the prime mover 140 and pivoting the lid 124 about the pivot 142. The lid 124 preferably lifts, during operation, about six to about eight inches, thereby moving the anvils 130 and 131 about the hinge 142, which provides a greater gap between the blow bar 128 and the anvils 130 and 131 to allow the blocking material to pass.

The preferred embodiment of the present invention is advantageous because the blockage clearance operation can take place while the machine is operating. The mechanical function of lifting the lid, which also moves the anvils away from the blow bars, allows room for the blocked materials to move more freely, and is a substantial time and manpower saving process. In order to clear a blockage, there is no longer a need to (1) turn off the machine and wait several minutes for the rotor to stop rotating; (2) unbolt the tunnel top; (3) open the lid and (4) manually remove the blocked materials in order to clear a blockage.

The guards of the preferred embodiment prevent the materials from exiting the crusher at high speed while the machine is in a blockage clearance operation. Furthermore, the ability to perform this operation using a remote control is advantageous. There is no longer a need for workers to be on or around the machine while it is operating. A worker who is a safe distance from the operating machine can remotely activate the blockage clearance operation and not be in a position where safety is threatened.

While certain preferred embodiments of the present invention have been disclosed in detail, it is to be understood that various modifications may be adopted without departing from the spirit of the invention or scope of the following claims.

The invention claimed is:

1. A crusher blockage clearance apparatus mounted to a crusher having a housing, the housing having an opening through which crushable materials pass before being crushed, the opening defined by a gap extending between an opening end of a lid having at least one anvil mounted to the lid and an opening portion of the housing, the housing containing a rotatable rotor with blow bars against which crushable materials are forced during operation, the blockage clearance apparatus comprising:

(a) a pivot mounted between the lid and the housing, the pivot being at a distal position spaced from the opening end of the lid, for displacing the opening end of the lid substantially vertically relative to the opening portion of the housing, thereby changing the height of the opening;

(b) at least one prime mover drivingly linking the lid and the housing for pivoting the lid and attached anvil about the pivot relative to the rotor; and (c) at least one guard positioned adjacent the lid, the guard extending from near the opening end of the lid along at least a substantial portion of the length of the lid for restricting exit of the materials inside the crusher during a blockage clearance operation.

2. The blockage clearance apparatus in accordance with claim 1, further comprising at least one stop that is removably mounted to the lid near the end of the lid that is farthest from the pivot for limiting a range of motion of the lid in a direction that increases the opening height.

3. The blockage clearance apparatus in accordance with claim 2, further comprising at least one sensor positioned near the lid for sensing the lid's position and limiting the range of motion of the lid in a direction that increases the opening height while the crushing apparatus is in a blockage clearance operation.

4. The blockage clearance apparatus in accordance with claim 3, further comprising at least one tunnel top removably mounted to the lid distal from the pivot.

5. The blockage clearance apparatus in accordance with claim 3, further comprising a computer connected to said at least one sensor and the prime mover.

6. A crusher blockage clearance apparatus mounted to a crusher having a housing, the housing having an opening through which crushable materials pass before being crushed, the opening defined by a gap extending between an opening end of a lid having at least one anvil mounted to the lid and opening portion of the housing, the housing containing a rotatable rotor with blow bars against which crushable materials are forced during operation, the blockage clearance apparatus comprising:

(a) a pivot mounted between the lid and the housing, the pivot being at a distal position spaced from the opening end of the lid, for displacing the opening end of the lid substantially vertically relative to the opening portion of the housing, thereby changing the height of the opening;

(b) at least one prime mover drivingly linking the lid and the housing for pivoting the lid and attached anvil about the pivot relative to the rotor;

(c) at least one sensor positioned near the lid for sensing the lid's position and limiting the range of motion of the lid in a direction that increases the opening height while the crushing apparatus is in a blockage clearance operation;

(d) a computer connected to said at least one sensor and the prime mover; and (e) at least one guard positioned adjacent the lid, the guard extending from near the opening end of the lid along at least a substantial portion of the length of the lid for restricting exit of the materials inside the crusher during a blockage clearance operation.

7. The blockage clearance apparatus in accordance with claim 6, further comprising at least one tunnel top removably mounted to the lid distal from the pivot.

8. The blockage clearance apparatus in accordance with claim 7, further comprising at least one stop that is mounted to the lid near the end of the lid that is farthest from the pivot for limiting a range of motion of the lid in a direction that increases the opening height.

9. The blockage clearance apparatus in accordance with claim 6, further comprising at least one stop that is mounted to the lid near the end of the lid that is farthest from the pivot for limiting a range of motion of the lid in a direction that increases the opening height.

10. A crusher blockage clearance apparatus mounted to a crusher having a housing, the housing having an opening through which crushable materials pass before being crushed, the opening defined by a gap extending between an opening end of a lid having at least one anvil mounted to the lid and an opening portion of the housing, the housing containing a rotatable rotor with blow bars against which crushable materials are forced during operation, the blockage clearance apparatus comprising:

(a) a pivot mounted between the lid and the housing the pivot being at a distal position spaced from the opening end of the lid, for displacing the opening end of the lid substantially vertically relative to the opening portion of the housing, thereby changing the height of the opening;

(b) at least one tunnel top removably mounted to the lid distal from the pivot;

(c) at least one stop, mounted to the tunnel top for limiting a range of motion of the lid in a direction that increases the opening height;

(d) at least one prime mover drivingly linking the lid and the housing for pivoting the lid and attached anvil about the pivot relative to the rotor; and (e) at least one sensor positioned near the lid for sensing the lid's position and limiting the range of motion of the lid in a direction that increases the opening height while the crushing apparatus is in a blockage clearance operation;

(f) a computer connected to the sensors and the prime mover; and (g) at least one guard positioned adjacent the lid, the guard extending from near the opening end of the lid along at least a substantial portion of the length of the lid for restricting exit of the materials from inside the crusher during the blockage clearance operation.

11. The blockage clearance apparatus in accordance with claim 10, wherein said at least one tunnel top is removed from the lid, when not in operation, for servicing the crushing apparatus.

12. The blockage clearance apparatus in accordance with claim 11, further comprising tacks mounted beneath the apparatus for moving the apparatus across the ground.

13. The blockage clearance apparatus in accordance with claim 11, further comprising wheels and a hitch mounted beneath the apparatus for moving the apparatus across the ground.

* * * * *

UNITED STATES PATENT AND TRADEMARK OFFICE

CERTIFICATE OF CORRECTION

PATENT NO. : 7,229,041 B2
APPLICATION NO. : 10/881110
DATED : June 12, 2007
INVENTOR(S) : Douglas J. Cohen et al.

It is certified that error appears in the above-identified patent and that said Letters Patent is hereby corrected as shown below:

Col. 9, line 6 add --tracks--, delete "tacks"

Signed and Sealed this

Thirty-first Day of July, 2007

JON W. DUDAS
*Director of the United States Patent and Trademark Office*